US010493315B2

(12) United States Patent
Rubin et al.

(10) Patent No.: US 10,493,315 B2
(45) Date of Patent: Dec. 3, 2019

(54) SLEDMILL EXERCISE APPARATUS

(71) Applicant: SledMill Inc., Montreal (CA)

(72) Inventors: Andrew Rubin, Lavaltrie (CA); Jeffrey Saibil, Lavaltrie (CA)

(73) Assignee: SLEDMILL INC., Montreal QC (CA)

( * ) Notice: Subject to any disclaimer, the term of this patent is extended or adjusted under 35 U.S.C. 154(b) by 315 days.

(21) Appl. No.: 15/406,978

(22) Filed: Jan. 16, 2017

(65) Prior Publication Data

US 2018/0200567 A1 Jul. 19, 2018

(51) Int. Cl.

*A63B 21/00* (2006.01)
*A63B 22/02* (2006.01)
*A63B 23/04* (2006.01)

(52) U.S. Cl.

CPC ..... *A63B 21/4035* (2015.10); *A63B 21/4033* (2015.10); *A63B 22/0235* (2013.01); *A63B 23/047* (2013.01); *A63B 2225/09* (2013.01)

(58) Field of Classification Search

None

See application file for complete search history.

(56) References Cited

U.S. PATENT DOCUMENTS 3,684,283 A * 8/1972 Forrest ..... A63B 69/345 473/445
4,302,023 A * 11/1981 Kiesz ..... B62B 3/02 108/106
4,687,196 A * 8/1987 Dubrinsky ..... A61H 3/00 482/54
6,220,992 B1 * 4/2001 Shafik ..... A63B 69/20 482/104
6,367,015 B1 5/2002 Watson
6,454,679 B1 * 9/2002 Radow ..... A63B 22/0235 482/4
6,482,128 B1 * 11/2002 Michalow ..... A63B 69/0028 482/100
6,676,569 B1 * 1/2004 Radow ..... A63B 22/0235 482/4
6,685,581 B2 * 2/2004 Krause ..... A63B 69/004 473/441
6,824,504 B2 * 11/2004 Ott ..... A63B 21/072 473/438
7,066,865 B2 * 6/2006 Radow ..... A63B 22/0235 482/1
7,104,939 B1 * 9/2006 Martinez ..... A63B 21/068 482/142

(Continued)

*Primary Examiner* — Stephen R Crow

(74) *Attorney, Agent, or Firm* — Philip Swain; IPSIS, Inc.

(57) ABSTRACT

A sledmill exercise apparatus. The apparatus has a frame with two spaced apart upright supports, which is stabilized to prevent tipping. The frame has a spacer bar between the supports and is moveably connected to it to vary the distance between the bar and the ground. The frame has two handles moveably connected to the bar to vary the distance between the handles. The bar is lockable in one position and the handles are lockable in a holding position. An endless drive belt with a driving surface contacts a user's foot. The supports are sufficiently spaced apart to permit location of the belt adjacent the frame. The bar position and the holding position are such that the user achieves a desired biomechanical position which allows forward and backward resistant movement of the belt relative to the frame.

17 Claims, 10 Drawing Sheets

(56) References Cited

U.S. PATENT DOCUMENTS

| | | | | |
|---|---|---|---|---|
| 7,494,450 | B2 * | 2/2009 | Solomon | A61H 1/0229 482/51 |
| 7,608,015 | B2 * | 10/2009 | Radow | A63B 22/0235 482/4 |
| 7,678,028 | B1 * | 3/2010 | Gore | A63B 69/004 482/86 |
| 7,857,739 | B2 * | 12/2010 | Caldwell | A63B 21/00047 482/130 |
| 7,922,628 | B2 * | 4/2011 | Gonzalez | A63B 69/004 482/83 |
| 8,241,188 | B2 | 8/2012 | Robinson | |
| 8,444,533 | B2 | 1/2013 | Robinson | |
| 8,986,172 | B2 * | 3/2015 | Poole | A63B 21/0552 473/441 |
| 9,192,803 | B2 * | 11/2015 | Cayo | A63B 21/0618 |
| 9,227,101 | B2 * | 1/2016 | Maguire | A63B 22/02 |
| 9,254,417 | B2 * | 2/2016 | Lawrence | A63B 24/00 |
| 9,713,741 | B1 * | 7/2017 | Tolliver | A63B 23/12 |
| 2004/0242385 | A1 * | 12/2004 | Emick | A63B 21/0724 482/106 |
| 2011/0082013 | A1 * | 4/2011 | Bastian | A63B 22/0235 482/54 |
| 2014/0187389 | A1 * | 7/2014 | Berg | A61H 1/0237 482/91 |
| 2015/0231475 | A1 * | 8/2015 | Tompkins | A63B 69/345 473/445 |

* cited by examiner

SLEDMILL EXERCISE APPARATUS

TECHNICAL FIELD

The present relates to exercise apparatus, and more particularly to a stationary resistive sledmill exercise apparatus.

BACKGROUND

Regular cardiovascular exercise regimes combined with strength training are well known to develop and maintain health and well being for most people. Cross training is important not only to maintain strength and fitness and to reduce over-use injury, but also to prevent boredom, by varying exercise routines.

Exercise equipment that is easy to use is a desirable way to exercise when time is limited or during winter months when exercise outside is impractical. There are many different types of exercise equipment currently on the market, for example, treadmills, sleds, rowing machines, skiing machines and the like, which vary in price and complexity. A particular type of exercise equipment is the sledmill, which the user can push and pull across a floor. The sledmill is typically weighted to provide appropriate resistance. However, disadvantageously, the use of the sledmill requires considerable floor space to be used effectively. The inventors are aware of the designs, which combine treadmill with a holding means or a harness. These designs include the following:

U.S. Pat. No. 8,444,533 to Robinson for "Exercise Apparatus and Training Method";

U.S. Pat. No. 8,241,188 to Robinson for "Exercise Apparatus";

U.S. Pat. No. 6,454,679 to Radow for "Bipedal locomotion training and performance evaluation device and method"; and U.S. Pat. No. 6,367,015 to Watson for "Exercise apparatus employing counter-resistive treading mechanism".

Disadvantageously, the designs described above have many parts, which adds to their complexity. It is likely that these designs would require considerable maintenance, and would likely be prohibitively expensive for many users. Furthermore, none of the designs allow the user to simultaneously modify the width of neither a handle part of the stationary apparatus, nor the height of a cross bar to which the handle part is connected. Importantly, none of the aforesaid machines offer the user forwards and backwards resistance in the desired biomechanical position in a restricted floor space. For example, none of the machines described permit sagittal plane resisted movement which is key to developing multi-plane strength and agility Thus, there is a need for a stationary sledmill exercise apparatus which includes a resistance training feature that is easy to use, inexpensive to manufacture, transport, store and can be used in a location where space is limited.

BRIEF SUMMARY

We have designed a stationary resistive sledmill apparatus, which significantly reduces, or essentially eliminates, the problems discussed above. To achieve this, we have designed a new and unobvious sledmill exercise apparatus by combining an upstanding frame with endless drive belt. The frame includes a height and width adjustable handle system and which when used with the drive belt provides significant improvements over the designs described above. The frame of our sledmill apparatus is located over the drive belt so that the user can carry out sled pushing and pulling exercises without having to push the frame across a large area. The handle system permits a user to push forward, whereas a harness attachment permits the user to pull forwards and backwards. A rope attachment can also be used to permit lateral pulling. The handle system is easy to adjust, so that the apparatus can be modified to accommodate users of every size. Once the handle bars are adjusted, the user can use the apparatus in the most ergonomically and biomechanically productive position to train. Every step the user takes on the drive belt is a closed-chain single leg hip extension, which also strengthens and improves the user's core stability. Furthermore, the apparatus additionally aids helps to strengthen and stabilize the entire shoulder girdle and the scapula. The versatility of our apparatus is realized when it is converted into a pushing sled, which is useful for developing strength and power in not only all three gluteal but also the entire posterior chain. It is known that squats and deadlifts build an athletic body. Our apparatus combines both of these strength exercises with very efficient cardiovascular activity. Our apparatus provides a full body workout that does not apply a heavy load on the body's joints—a conventional sledmill generally requires the addition of weights give resistance. Finally, a typical sledmill usually requires a large area on which to operate. This area must include a length of flooring such as AstroTurf, a sled, and an amount of weight to weigh down the sled. Our apparatus allows the user to achieve the same results from pushing and pulling the sled, but from the comfort and convenience of their own home. Moreover, if used in a commercial gymnasium, our apparatus frees up considerable floor space, which can be used to accommodate other exercise equipment.

Accordingly, in one embodiment there is provided a sledmill exercise apparatus, the apparatus comprising:

a) a frame having first and second spaced apart upright supports, the frame being stabilized to prevent tipping, the frame having a first spacer bar located between the upright supports, the first spacer bar having a user contact member, the first spacer bar being moveably connected to the upright supports so as to vary the distance between the first spacer bar and the ground, the first spacer bar being lockable in a first spacer bar position; and b) an endless drive belt having a driving surface for contacting at least one foot of the user, the first and second upright supports being spaced apart a sufficient distance to permit location of the endless drive belt adjacent the frame, the first spacer bar position being such that the user contacts the contact member and the driving surface in a desired bio-mechanical position to permit forward and backward resistant movement of the endless belt relative to the frame.

In one example, the user contact member includes first and second handles moveably connected to the first spacer bar to vary the distance between the two handles, the first and second handles being lockable in a first holding position, the first spacer bar position and the first holding position being such that the user achieves the desired bio-mechanical position to permit forward and backward resistant movement of the endless belt relative to the frame.

In another example, the first spacer bar includes first and second spacer bar connector ends, the first and second spacer bar connector ends being connected to the respective upright supports to permit movement of the first spacer bar relative to the endless drive belt to vary a first distance therebetween, the first and second spacer bar connector ends being lockingly engaged to the respective first and second upright supports to lock the first spacer bar.

In another example, the first handle includes a first handle connecting end and the second handle includes a second handle connecting end, the first and second handle connecting ends being connected to the first spacer bar to permit movement of the first and second handles relative to each other to vary a second distance therebetween, the first and second handle connecting ends being lockingly engaged to the first spacer bar to lock the handles. The first and second handles and the first spacer bar being configured to permit the user to hold the handles to permit orientation of the user's body to achieve a sled push position.

In another example, the user contact member includes a pad connected to the first spacer bar, the pad being sized and shaped to permit the user to locate the back thereagainst to permit orientation of the user's body in a seated leg extension position.

In another example, the first and second handle connecting ends include first and second handle sleeves sized and shaped to permit the first and second handles to slide along the first spacer bar towards and away from each other. A first and second releasable lock engages the respective first and second connecting ends to lock the first and second handles in place.

In one example, the apparatus further includes a second spacer bar fixably connected to the first and second upright supports, the second spacer bar being located between the first spacer bar and the endless drive belt.

In another example, the first and second spacer bar connecting ends include first and second spacer bar sleeves sized and shaped to permit the first and second spacer bar connecting ends to slide along the first and second upright supports towards and away from the endless drive belt.

In another example, a third and fourth lock engages the respective first and second connecting ends to lock the first spacer bar in place once the second distance is achieved.

In yet another example, first and second stabilizers are connected to the first and second supports.

Accordingly in another embodiment, there is provided a sledmill exercise apparatus, the apparatus comprising:

a) a frame having first and second spaced apart upright supports, the frame being stabilized to prevent tipping, the frame having a first spacer bar located between the upright supports, the first spacer bar having a pulling member connected thereto; and b) an endless drive belt having a driving surface for contacting at least one foot of the user, the first and second upright supports being spaced apart a sufficient distance to permit location of the endless drive belt adjacent the frame, the first spacer bar position being such that the user applies a pulling force to the pulling member and contacts the driving surface in a desired bio-mechanical position to permit forward and backward resistant movement of the endless belt relative to the frame.

In one example, a connector member is connected to the first spacer bar, the pulling member being connected thereto.

In another example, a belt connected to the pulling member to permit orientation of the user's body to achieve a backward pull movement.

In another example, a belt is connected to the pulling member to permit orientation of the user's body to achieve a forward pull movement.

In still another example, a handle is connected to the pulling member to permit orientation of the user's body to achieve a backward pull movement.

In one example, the apparatus further includes a second spacer bar located between the upright supports, the second spacer bar being moveably connected to the upright supports so as to vary the distance between the second spacer bar and the ground, the second spacer bar being lockable; and first and second handles moveably connected to the second spacer bar to vary the distance between the two handles, the first and second handles being lockable.

In another example, first and second stabilizers are connected to the first and second upright supports.

In yet another example, a rope is connected to the connector member to permit lateral pulling.

BRIEF DESCRIPTION OF THE DRAWINGS

These and other features of that described herein will become more apparent from the following description in which reference is made to the appended drawings wherein.

DETAILED DESCRIPTION

Definitions

Unless otherwise specified, the following definitions apply:

The singular forms "a", "an" and "the" include corresponding plural references unless the context clearly dictates otherwise.

As used herein, the term "comprising" is intended to mean that the list of elements following the word "comprising" are required or mandatory but that other elements are optional and may or may not be present.

As used herein, the term "consisting of" is intended to mean including and limited to whatever follows the phrase "consisting of". Thus, the phrase "consisting of" indicates that the listed elements are required or mandatory and that no other elements may be present.

Figure 3:
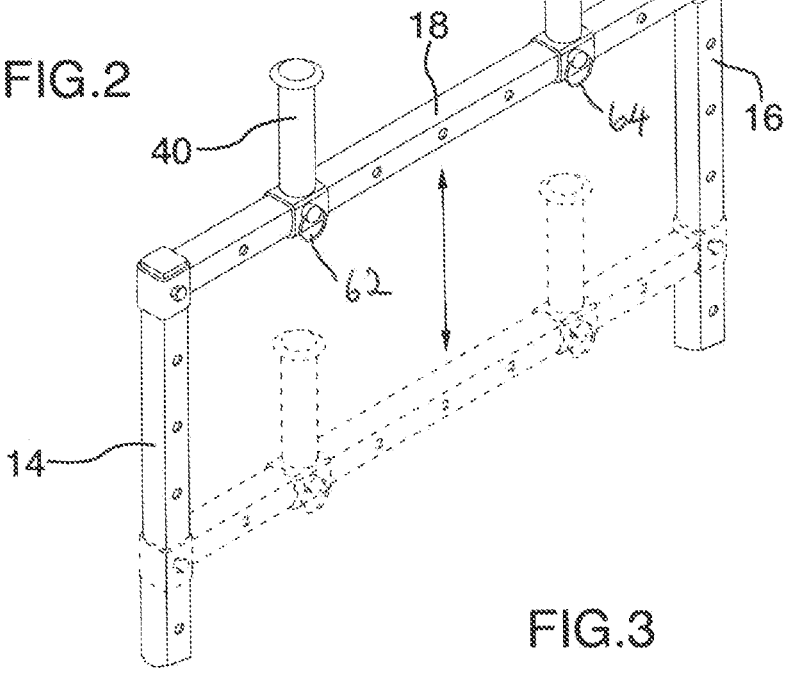
FIG. 3 is a perspective detailed view of the handle system of FIG. 2 showing a support bar being moveable along a vertical path of travel.

Referring now to FIGS. 1, 5, 6 and 7, a sledmill exercise apparatus is shown generally at 10. Broadly speaking, the apparatus 10 includes a frame 11 and an endless drive belt 12, which is typically an endless loop of tread mounted on a series of rollers. The endless drive belt 12 includes a driving surface 13 for contacting at least one foot of a user and a motor (not shown). The frame 11 has first and second upright supports 14, 16, a first spacer bar 18, a second spacer bar 20, a third spacer bar 22 and two stabilizers 24, 26. Each stabilizer 24, 26 include base supports 28, 30, and two angled bars 32, 34 connected to the upright supports 16, 18 and the two base supports 28, 30. Although the supports 14, 16 and the spacer bars 18, 20, 22 are shown as cuboid when view in cross section, a person skilled in the art will recognize that any cross sectional shape can be used. The first spacer bar 18 includes a user contact member 15, which is described below. If desired, the frame 11 can be secured to a wall any other available secure member. The endless drive belt 12 provides resistance using two independent mechanisms: a) using mechanical friction which is manually adjustable; and b) by applying an electromagnetic load on the belt's 12 motor. The motor is used as an electrical generator using the similar principle as a dynamo. In the case of the sledmill, instead of transforming and transferring the mechanical energy into electricity, the energy is transformed into a very high electronic load. In our sledmill, three different electronic loads were used, although it is possible to provide an infinite number of loads by using a variable electronic load using, for example, a potentiometer or a variable resistor. The three load settings are: 1) Running free with no charge and no electrical resistant connected to the motor; 2) The motor is connected to a small resistance; and 3) The motor is shorted, which is created by maximum resistance. As is generally known to those skilled in the art, a motor is a combination of a static magnet side (a stator) and a dynamic side (a rotor). When the dynamic side (the rotor) is connected to an electrical short, the magnetic field stays fixed and the motor stops rotating. As soon as an electrical resistance is applied in series to the circuit, the electromagnetic field begins to decrease As best seen in FIG. 3, the stabilizers 24, 26 are triangulated when viewed from the side. This provides considerable stability to the frame 11 when in use and prevents it from tipping over.

Figure 1:
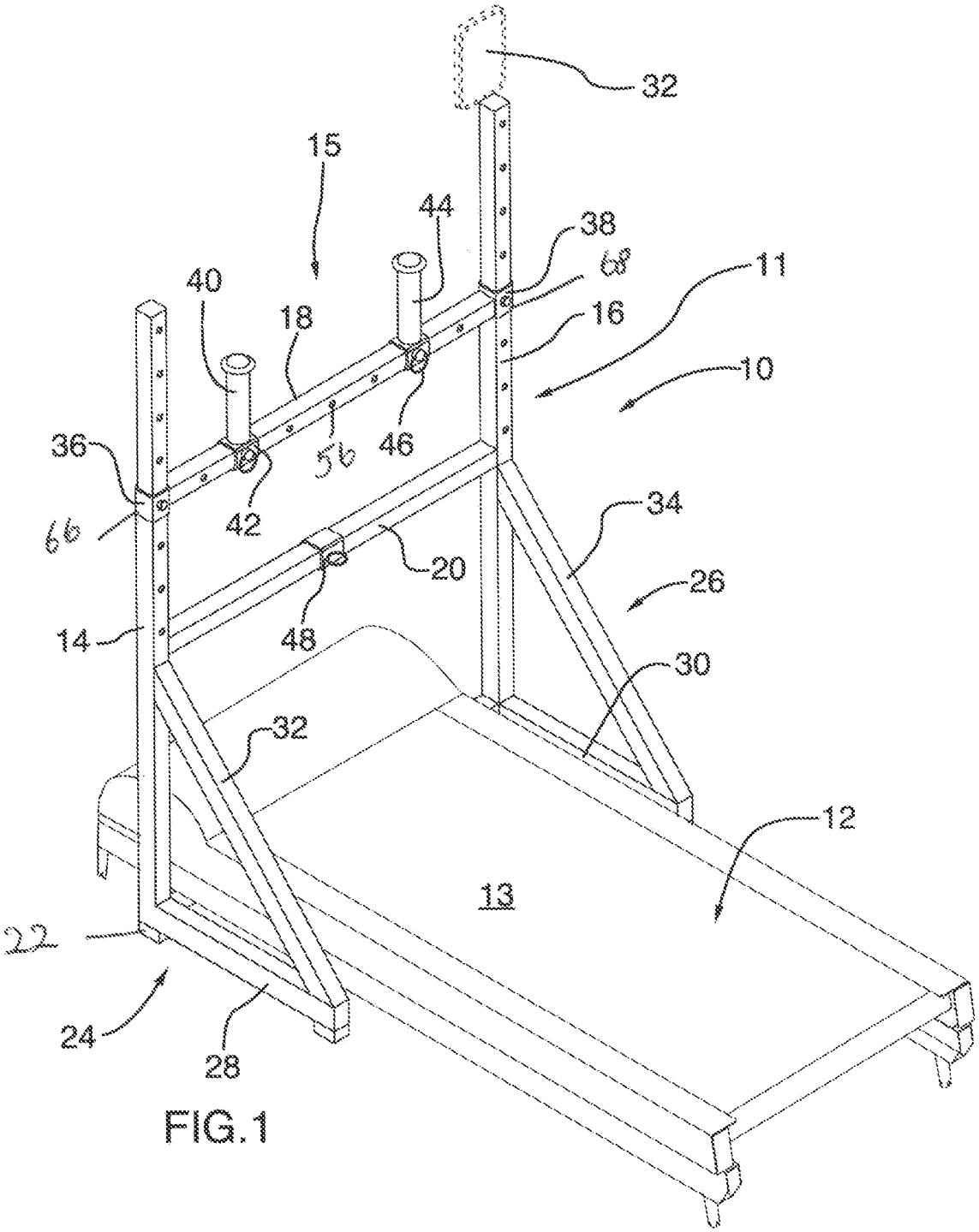
FIG. 1 is perspective top view of a sledmill exercise apparatus showing a frame, an endless drive belt and a programmable electronic device.

As best seen in FIGS. 1 and 3, the two upright supports 14, 16 of the frame 11 are located generally orthogonal to the endless drive belt 12 and are spaced apart to allow the endless drive belt 12 to be located adjacent the frame 11, which in the example illustrated is between the supports 14, 16. A person skilled in the art will readily recognize that the distance between the two supports 14, 16 can be modified to accommodate endless drive belts of different widths. A smartphone or tablet 32, or indeed any other control device, can be located near the apparatus 10 to either operate the speed and/or resistance of the drive belt 12, or to program an exercise regime so that the user can carry out a timed workout. Additional hardware and software can be used to monitor heartbeat, oxygen consumption and the like, or any typical exercise parameter known to those skilled in the art.

Figure 2:
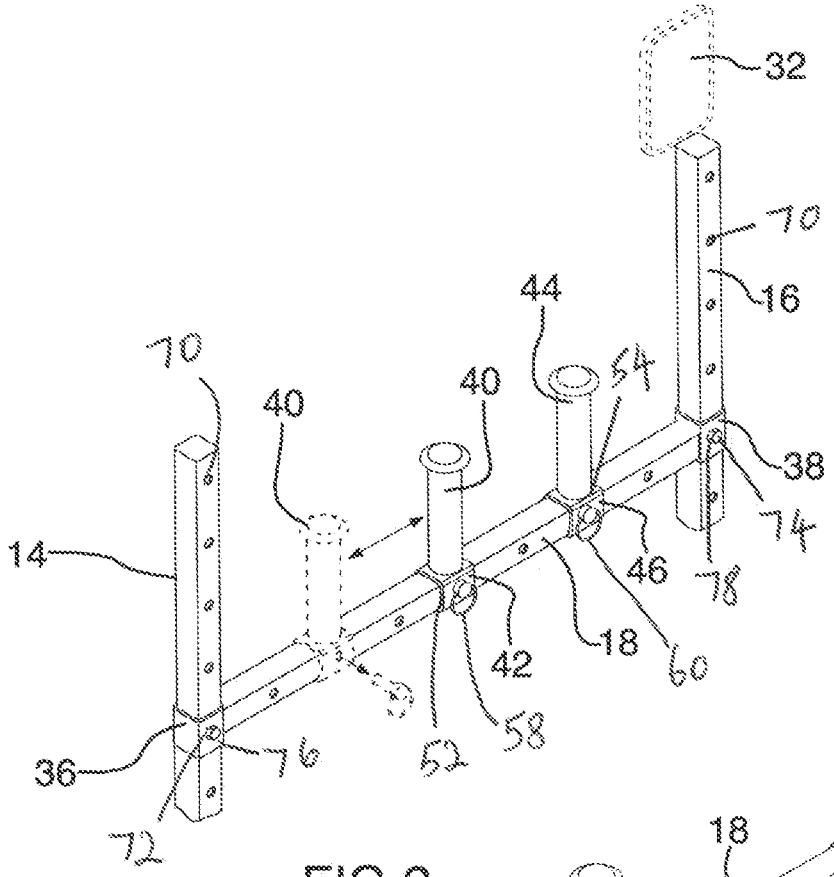
FIG. 2 is a perspective detailed view of a handle system showing one grip being moveable relative to another grip along a horizontal axis of travel.

Referring now to FIGS. 1, 2 and 3, the user contact member 15 is located at the first spacer bar 18, which is located between the two upright supports 14, 16. The spacer bar 18 has a first spacer bar connecting end 36 and a second spacer bar connecting end 38 located at either end of the bar 18. The first and second spacer bar connecting ends 36, 38 are connected to the respective first and second supports 14, 16 to permit movement of the first spacer bar 18 towards and away from the endless drive belt 12 so as to vary a first distance between the spacer bar 18 and the endless drive belt 12.

Referring specifically to FIGS. 2 and 3, a first handle 40 has a first handle connecting end 42 and a second handle 44 has a second handle connecting end 46. The first and second handle connecting ends 42, 46 are connected to the first spacer bar 18 to permit movement of the first and second handles 40, 44 relative to each other, as shown by the arrows in FIG. 2, to vary a second distance therebetween.

Figure 10:
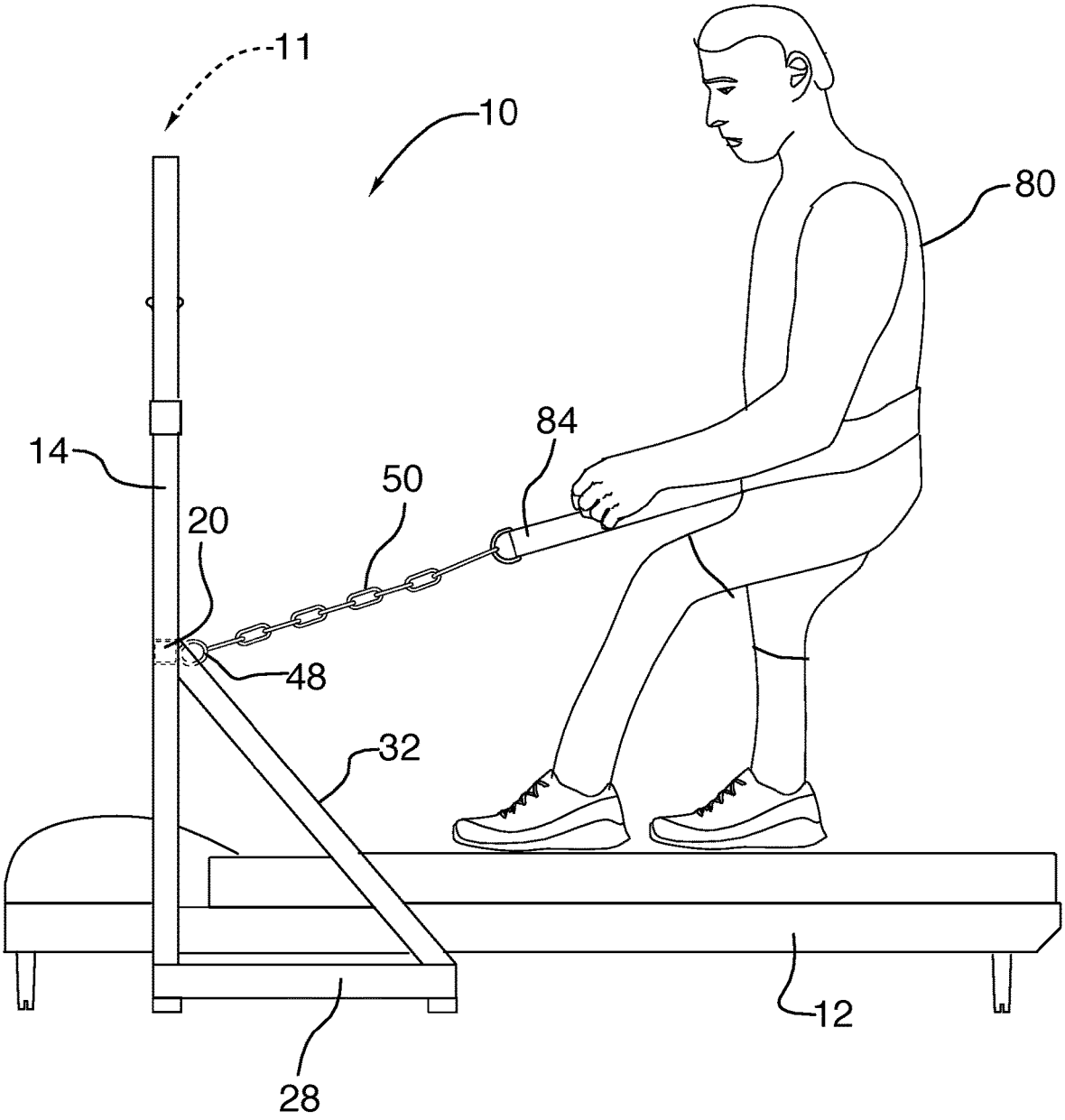
FIG. 10 is a side view of the exercise apparatus with a user in a backwards pull with belt attachment.
Figure 11:
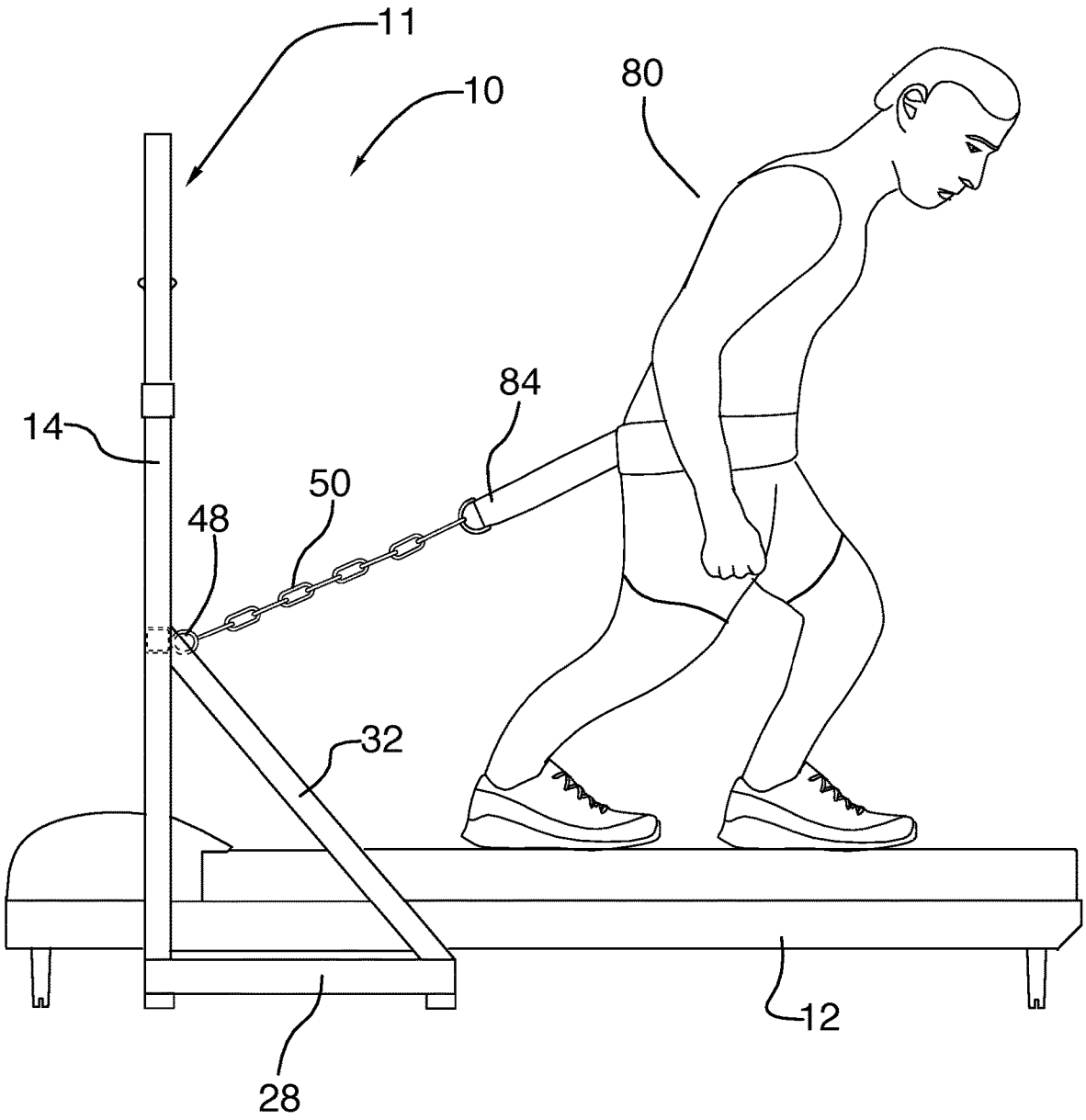
FIG. 11 is a side view of the exercise apparatus with a user in a forwards pull with belt attachment.
Figure 12:
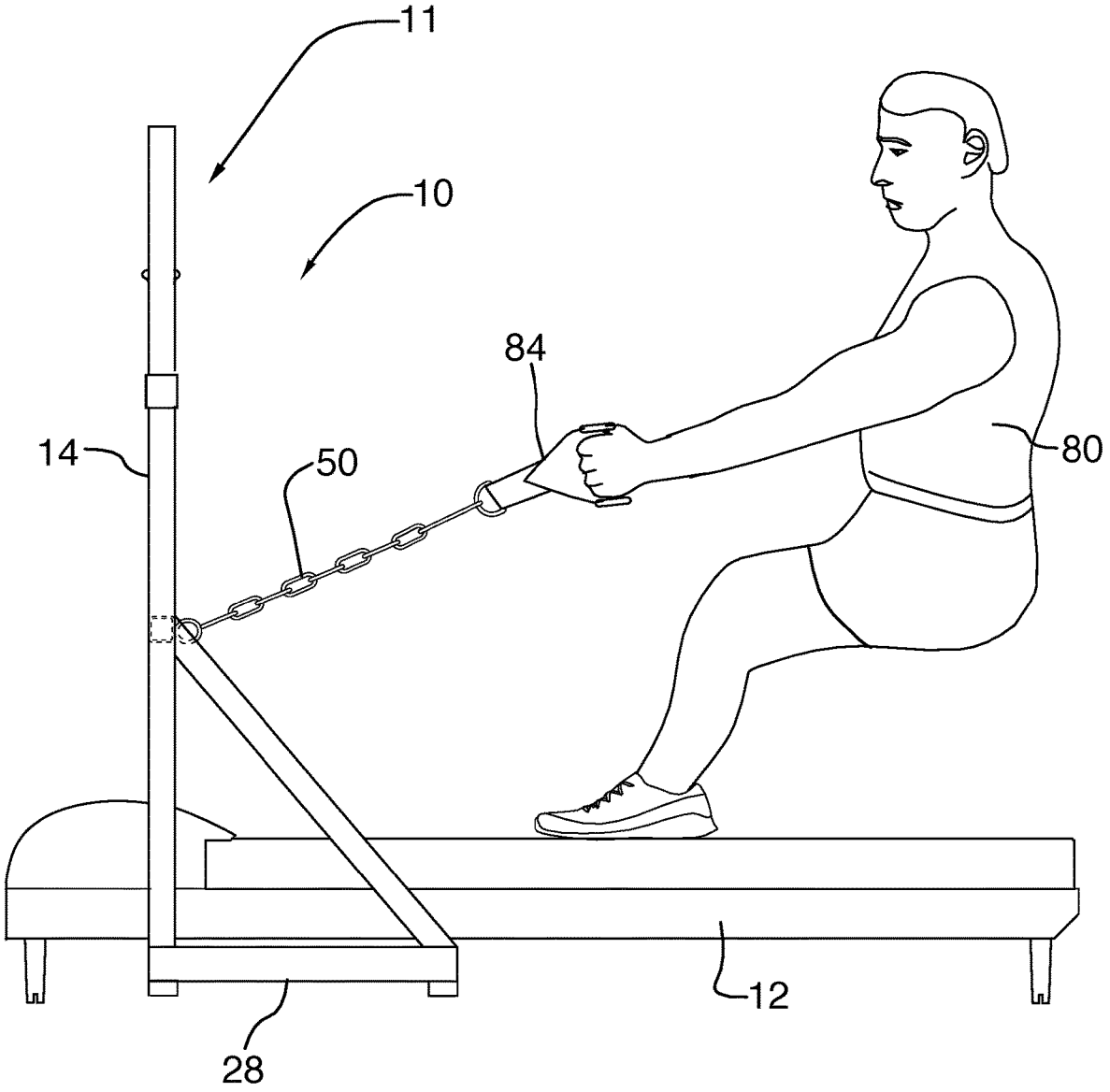
FIG. 12 is a side view of the apparatus with a user in a backward pull with handle attachment.

Referring back to FIG. 1, and now to FIGS. 10, 11 and 12, the second spacer bar 20 is fixably connected to the first and second supports 14, 16, and is located between the first spacer bar 18 and the endless drive belt 12. A connector member 48 is connected to the second spacer bar 20 generally at the center point of the second spacer bar 20. The connector member 48 is located to permit a chain pulling member 50 to be connected thereto. In the examples shown, the pulling member 50 is a chain.

Referring now to FIGS. 1, 2 and 3, the first and second handle connecting ends 42, 46 include first and second handle sleeves 52, 54 sized and shaped to permit the first and second handles 40, 44 to slide along the first spacer bar 18 towards and away from each other to achieve the desired first distance therebetween. The first spacer bar 18 includes a plurality of spaced apart openings 56, which are spaced apart equidistant from each other along substantially the entire length of the bar 18. A first and second releasable lock 58, 60 engages the respective first and second handle connecting ends 42, 46 to lock the handles 40, 44 in place once the first distance is achieved. The releasable locks 58, 60 can be of any design known to those skilled in the art. In the example shown, looped pins 62, 64 engage two of the spaced apart openings 56 so that the desired first distance between the two handles 40, 44 are temporarily maintained.

Similarly, as shown in FIGS. 1 and 3, the first and second spacer bar connecting ends 36, 38 include first and second spacer bar sleeves 66, 68 sized and shaped to permit the first and second spacer bar connecting ends 36, 38 to slide along the first and second supports 14, 16 towards and away from the endless drive belt 12. Each of the supports 14, 16 includes a plurality of spaced apart openings (holes) 70, which are spaced apart equidistant from each other along substantially the entire length of the supports 14, 16. A third and fourth releasable lock 72, 74 engages the respective first and second spacer bar connecting ends 36, 38 to lock the first spacer bar 18 in place once the second distance is achieved. The releasable locks 72, 74 can be of any design known to those skilled in the art. In the example shown, pegs 76, 78 engage two of the spaced apart openings 70 so that the desired second distance between the first spacer bar 18 and the endless drive belt 12 is temporarily maintained. A person skilled in the art will recognize that although the sleeves 52, 54, 66, 68 are slidably mounted on their respective spacer bar 18 and upright supports 14, 16 to locate the locks adjacent the desired openings, many different types of connecting means are available, for example guide grooves along the supports/spacer bar to receive lockable pegs or a sleeve made of a resistant, contractible material which contracts around the support/spacer to allow locking in a resistance fashion.

Figure 4:
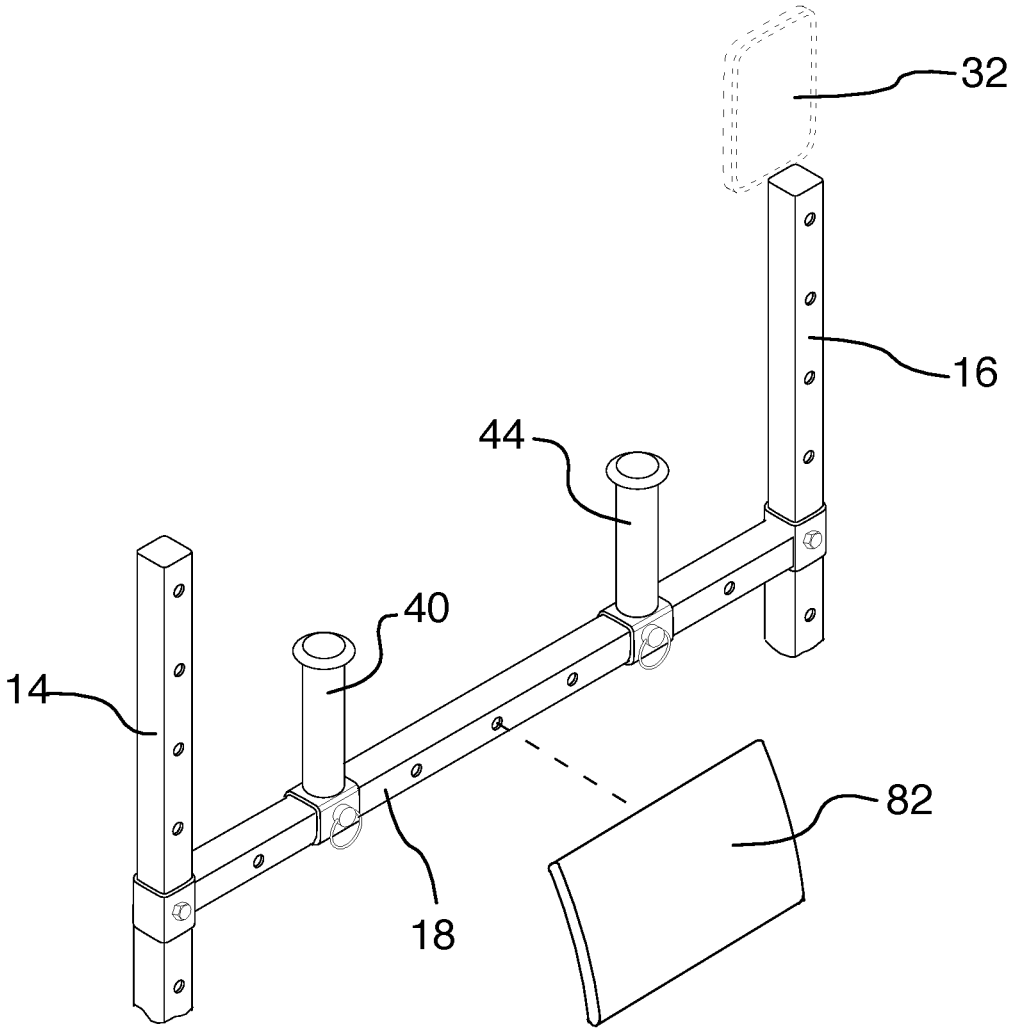
FIG. 4 is a perspective, partial exploded view of the handle system showing a back stability pad for supporting a user's back.
Figure 5:
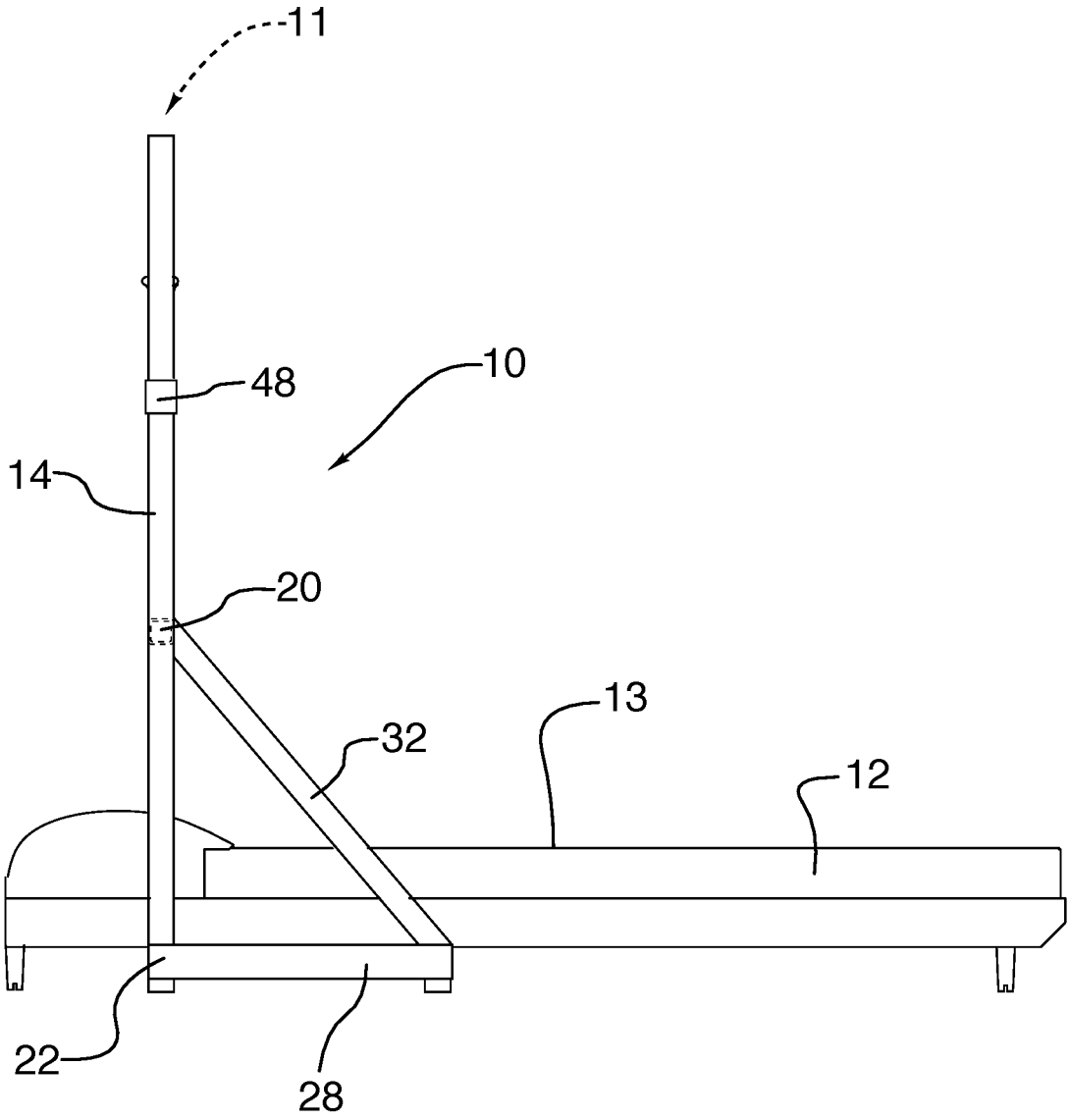
FIG. 5 is a side view of the frame and endless drive belt.
Figure 6:
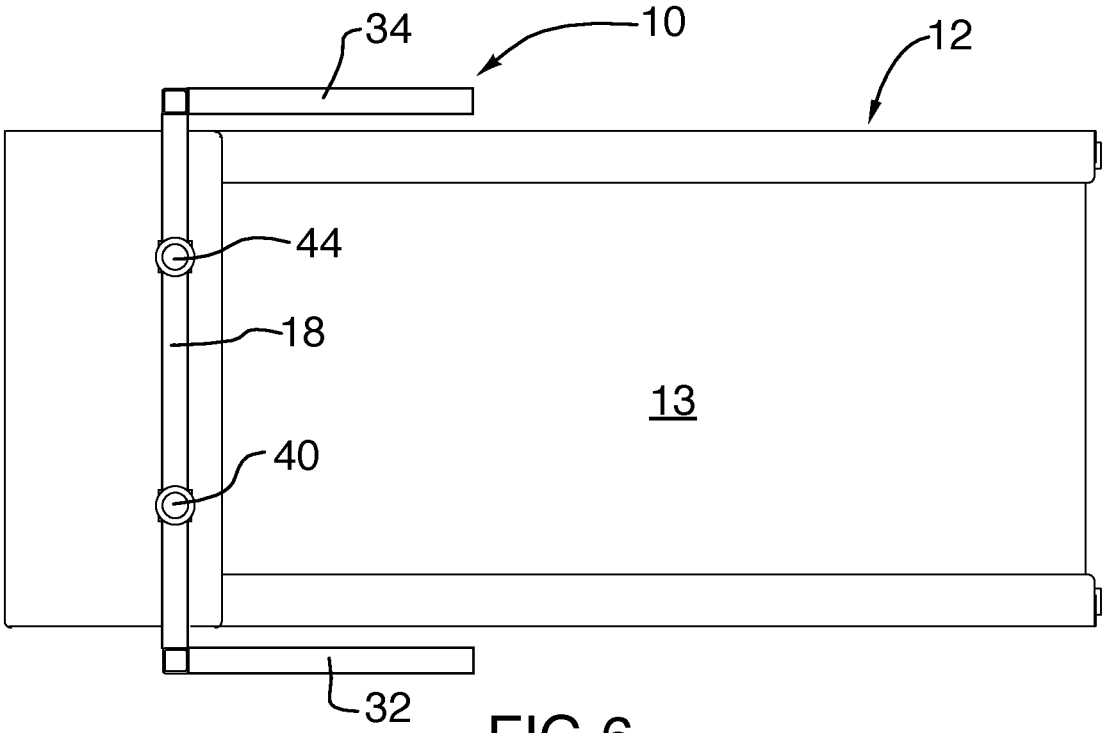
FIG. 6 is a plan view of the frame and endless drive belt.
Figure 7:
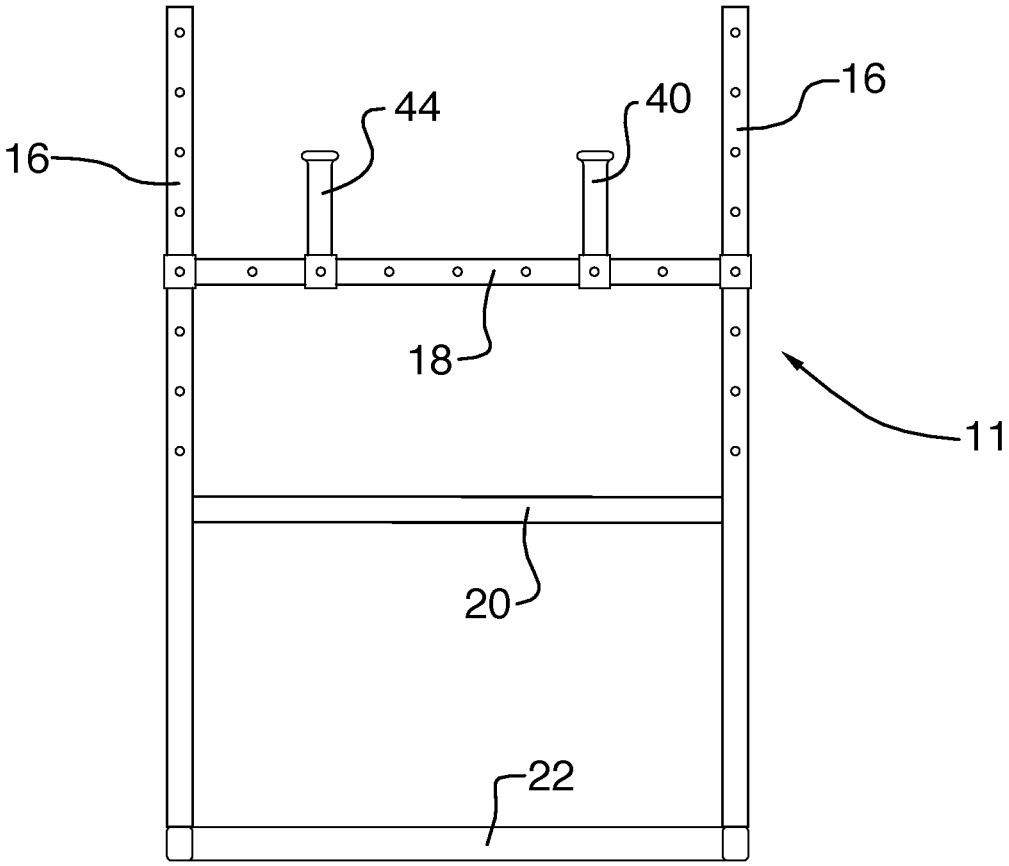
FIG. 7 is a rear view of the frame.
Figure 8:
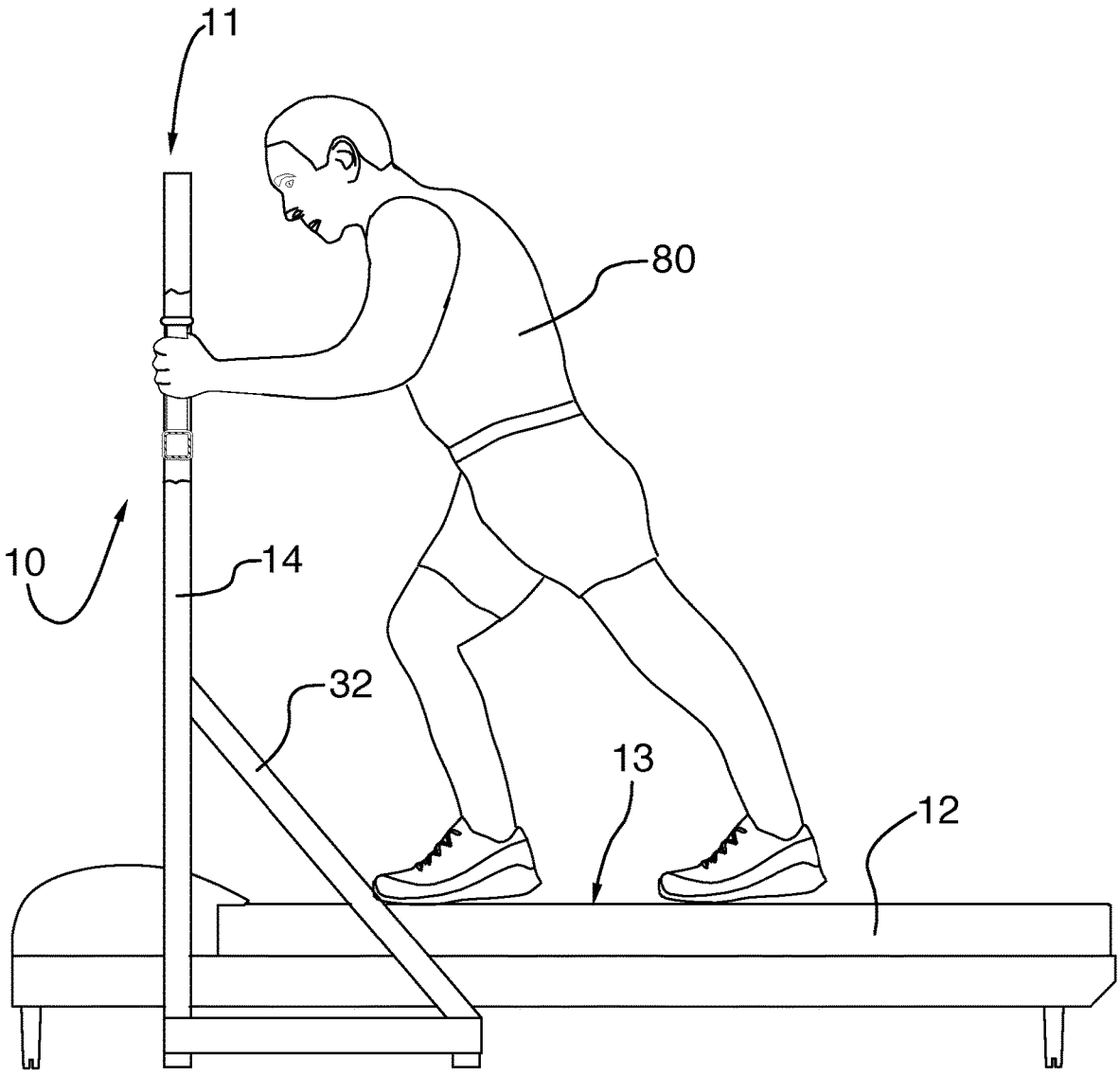
FIG. 8 is a side view of the exercise apparatus showing a user in a sled push position.
Figure 9:
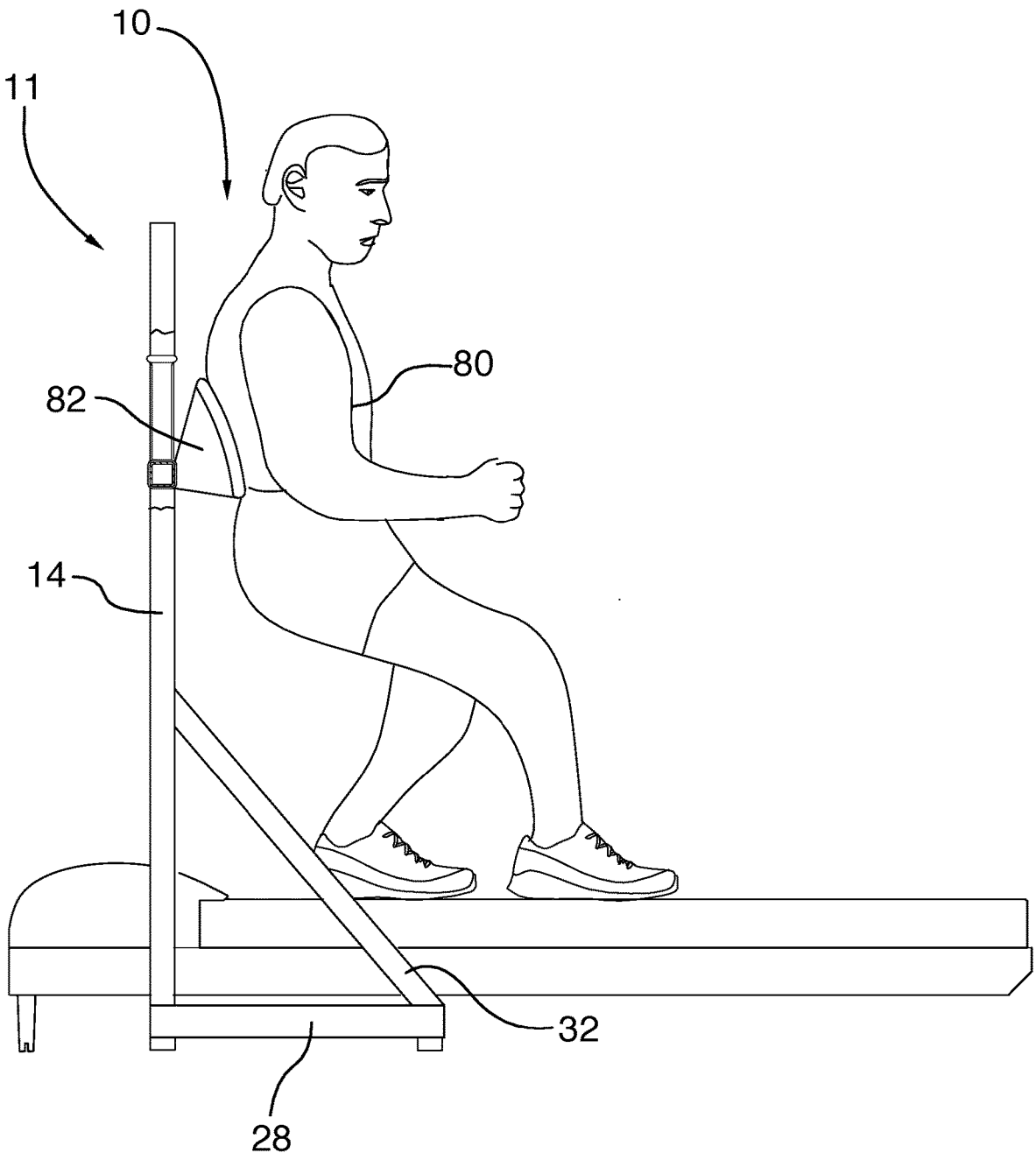
FIG. 9 is a side view of the exercise apparatus with a user in a seated leg extension position with the back stability pad.

Referring now to FIGS. 4, 8 and 9, one aspect of the exercise apparatus 10, which is lacking in the current designs, is its ability to be used for many different types of exercise. To carry out exercise to strengthen the quadriceps muscles is to have a user 80 squat with his/her back facing rearwardly. A pad 82 is connected to user contact member 15 at the first spacer bar 18 using any connecting means known to those skilled in the art, for example, a Velcro strip, hooks, a snapping mechanism and the like, and may be angled to provide optimal comfort to the user 80. The pad 82 is sized and shaped to permit the user to comfortably locate his back against the pad 82 to permit orientation of the user's body in a seated leg extension position, as best seen in FIG. 9.

The sledmill exercise apparatus 10 is, in essence, a single piece of exercise equipment, which can be easily dismantled and stored when not in use. The apparatus 10 can be used in areas of limited floor space, such as for example, in a home basement, a garage, or a home-based gymnasium. The endless drive belt 12 when located underneath the frame 11 can be electrically connected to a power supply and the remote controller or, if Bluetooth is used, anywhere a signal is found.

Operation

Before the exercise apparatus 10 is used, it must first be set up to accommodate the user's size and the desired exercise regime. Referring now to FIG. 2, the user 80 locates either the first or the second handle 40, 44 at a desired distance from one of the upright supports 14, 16 and then moves the other handle along the first spacer bar 18. The first and second spacer bar connecting ends 36, 38 are lockingly engaged to the respective first and second supports 14, 16 to lock the first spacer bar 18 at the first desired distance from the endless drive belt 12. The first and second handle connecting ends 36, 38 are lockingly engaged to the first spacer bar 18 to lock the handles 40, 44 at a second desired distance from each other.

Referring now to FIGS. 8 and 9, a number of exercise regimes are illustrated. Specifically, referring to FIG. 8, the user 80 holds onto both handles 40, 44 and while the endless drive belt 12 operates presses his/her weight towards the frame 11 so as to exercise in a sled push position with the legs pushing against the endless drive belt 12. With reference to FIG. 9, the user 80 rests his/her back against the pad 82 and with the legs pushes the endless drive belt 12 away from the frame 11 in a squat walking motion (a seated leg extension position).

Referring now to FIGS. 10, 11, and 12, the user 80 uses the pulling member 50 (chain) connected to the connector member 48 to carry out three different exercises. In FIG. 10, the user 80 is connected to the pulling member 50 using a belt/harness 84. The user 80 pulls while walking rearwardly facing away from the frame 11 in a backward pull exercise. In the opposition case, as illustrated in FIG. 11, the user 80 is walking away from the frame 11 in a so-called forwards pull exercise. Finally, in FIG. 12, the user 80 is seen carrying out a backward pull exercise using a grip 86 to pull rearwardly while walking on the endless drive belt 12. In this exercise, the user 80 positions his/her legs towards the frame 11, but in a squat position while walking rearwardly. In all of the exercise examples illustrated, the user 80 contacts the driving surface 13 of the endless drive belt 12, while his/her body is in a desired biomechanical position, which permits forward or backward resistant movement of the endless drive belt 12 relative to the frame 11. Also, the pulling member 50 can be replaced by a rope (not shown) to allow for lateral exercise movement in any of the positions illustrated and described above.

OTHER EMBODIMENTS

From the foregoing description, it will be apparent to one of ordinary skill in the art that variations and modifications may be made to the embodiments described herein to adapt it to various usages and conditions.

We claim:

1. A sledmill exercise apparatus, the apparatus comprising: a) a frame having first and second spaced apart upright supports, the frame being stabilized to prevent tipping, the frame having a first spacer bar located between the upright supports, the first spacer bar having a user contact member, the first spacer bar being moveably connected to the upright supports so as to vary the distance between the first spacer bar and the ground, the first spacer bar being lockable in a first spacer bar position; b) an endless drive belt having a driving surface for contacting at least one foot of the user, the first and second upright supports being spaced apart a sufficient distance to permit location of the endless drive belt adjacent the frame, the first spacer bar position being such that the user contacts the contact member and the driving surface in a desired bio-mechanical position to permit forward and backward resistant movement of the endless belt relative to the frame; and c) a control device operably connected to the endless drive belt for operating the speed and/or resistance thereof: wherein the user contact member includes first and second rigid handles handles, the first and second handles being lockable in a first vertical holding position, achieves the desired bio-mechanical position to permit forward and backward resistant movement of the endless belt relative to the frame.

2. The apparatus, according to claim 1, in which the first spacer bar includes first and second spacer bar connector ends, the first and second spacer bar connector ends being connected to the respective upright supports to permit movement of the first spacer bar relative to the endless drive belt to vary a first distance therebetween, the first and second spacer bar connector ends being lockingly engaged to the respective first and second upright supports to lock the first spacer bar.

3. The apparatus, according to claim 1, in which the first handle includes a first handle connecting end and the second handle includes a second handle connecting end, the first and second handle connecting ends being connected to the first spacer bar to permit movement of the first and second handles relative to each other to vary a second distance therebetween, the first and second handle connecting ends being lockingly engaged to the first spacer bar to lock the handles.

4. The apparatus, according to claim 1, in which the first and second handles and the first spacer bar being configured to permit the user to hold the handles to permit orientation of the user's body to achieve a sled push position.

5. The apparatus, according to claim 1, in which the user contact member includes a pad connected to the first spacer bar, the pad being sized and shaped to permit the user to locate the back thereagainst to permit orientation of the user's body in a seated leg extension position.

6. The apparatus, according to claim 3, in which the first and second handle connecting ends include first and second handle sleeves sized and shaped to permit the first and second handles to slide along the first spacer bar towards and away from each other.

7. The apparatus, according to claim 6, in which first and second releasable locks engage the respective first and second connecting ends to lock the first and second handles in place.

8. The apparatus, according to claim 1, further includes a second spacer bar fixably connected to the first and second upright supports, the second spacer bar being located between the first spacer bar and the endless drive belt.

9. The apparatus, according to claim 2, in which the first and second spacer bar connecting ends include first and second spacer bar sleeves sized and shaped to permit the first and second spacer bar connecting ends to slide along the first and second upright supports towards and away from the endless drive belt.

10. The apparatus, according to claim 7, in which third and fourth releasable locks engage the respective first and second connecting ends to lock the first spacer bar in place once the second distance is achieved.

11. The apparatus, according to claim 1, in which first and second stabilizers are connected to the first and second supports.

12. The apparatus, according to claim 1, in which a connector member is connected to the first spacer bar, the pulling member being connected thereto.

13. The apparatus, according to claim 12, in which a belt connected to the pulling member to permit orientation of the user's body to achieve a backward pull movement.

14. The apparatus, according to claim 12, in which a belt connected to the pulling member to permit orientation of the user's body to achieve a forward pull movement.

15. The apparatus, according to claim 12, in which a handle is connected to the pulling member to permit orientation of the user's body to achieve a backward pull movement.

16. The apparatus, according to claim 12, in which a rope is connected to the connector member to permit lateral pulling.

17. The apparatus, according to claim 1, in which the control device is a smartphone or a tablet.

* * * * *